United States Patent [19]

Vaccaro

[11] Patent Number: 4,723,329

[45] Date of Patent: Feb. 9, 1988

[54] AIR MATTRESS

[75] Inventor: Nicola Vaccaro, Niagara Falls, Canada

[73] Assignee: Nick Vaccaro International, Niagara Falls, Canada

[21] Appl. No.: 861,450

[22] Filed: May 9, 1986

[51] Int. Cl.[4] ..... A47C 27/10; A47C 27/08

[52] U.S. Cl. ..... 5/455; 5/449; 5/435; 441/129; 441/135

[58] Field of Search ..... 5/455, 449, 435, 431, 5/441, 465; 441/128, 129, 135; 297/DIG. 3; D6/604, 361; D21/237

[56] References Cited

U.S. PATENT DOCUMENTS

| | | | |
|---|---|---|---|
| 3,056,979 | 10/1962 | Holladay | 5/455 |
| 4,054,960 | 10/1977 | Pettit et al. | 5/455 |
| 4,138,753 | 2/1979 | Wood | 441/129 |
| 4,428,087 | 1/1984 | Horn | 5/455 |
| 4,473,913 | 10/1984 | Ylvisaker | 5/435 |

FOREIGN PATENT DOCUMENTS

| | | | |
|---|---|---|---|
| 1202100 | 1/1960 | France | 5/455 |
| 690523 | 4/1953 | United Kingdom | 5/455 |
| 903336 | 8/1962 | United Kingdom | 5/449 |
| 2105984 | 4/1983 | United Kingdom | 5/455 |

*Primary Examiner*—Alexander Grosz

*Attorney, Agent, or Firm*—Sim & McBurney

[57] ABSTRACT

A posturepedic buoyancy device for supporting a person lying on said device in water or on land in a manner to minimize postural strain comprises an inflatable mattress having attached thereto an inflatable lumbar elevation cushion on the top surface of the mattress. The cushion elevates a person's lumbo-sacral region sufficiently to minimize hyper-extension in the lumbar region while lying prone on the mattress. To further facilitate prone positioning of the person in a comfortable correct posture, the head region of the mattress has an elongate recess to receive and support a person's head when lying on top of the mattress. The recess is defined by opposing spaced-apart inflated mattress sections extending generally parallel to one another in the length direction of the mattress. The spacing between the mattress sections is such to support a person's head by contacting the cheekbones while accommodating the mouth and nose area to permit free breathing while lying in the prone position.

11 Claims, 7 Drawing Figures

AIR MATTRESS

FIELD OF THE INVENTION

This invention relates to inflatable air mattresses particularly adapted to provide as close as practical the ideal posture without undue stress on the body when lying in either the prone or supine positions.

BACKGROUND OF THE INVENTION

Inflatable air mattresses are most commonly used for purposes of floating in water normally for recreational purposes, although it is appreciated that they are useful in lifesaving situations, some types of recreational sports and in providing a comfortable mattress on which one may rest or sleep on dry land. If one is sunbathing on an air mattress, the person rotates from the prone to the supine position at regular intervals to provide an overall tan. Although the supine position is fairly comfortable on either land or water, the prone position can become very uncomfortable due to improper positioning of the head which is normally turned at 90° to the plane of the body and hyper-extension in the lumbo-sacral region of the person's spine. There has been no attempt to alleviate this improper posture of the person particularly when lying in the prone position while in water or on land.

It has been previously thought that air mattresses are useful only as recreational devices so that the standard type of air mattress should suffice, such as disclosed in U.S. Pat. Nos. 2,068,134, 2,939,158 and 3,068,494. It is appreciated that sections of the air mattress may be hingedly connected together to convert the mattress into either a chair or lounge, such as disclosed in U.S. Pat. No. 2,623,574. U.S. Pat. No. 2,717,399 discloses an adaptation to an air mattress which facilitates under water viewing while the user is lying in the prone position on the mattress. This is achieved by the provision of a circular hole through the mattress which has a transparent bottom. This permits positioning of the user's head over the hole so that they may inspect what is on the lake or sea bottom. The hole in the mattress is normally of eight to ten inches in diameter to permit full viewing of the sea bottom. In one embodiment, the head support is provided above the viewing aperture. The head support is a cushion which contacts the forehead which can cause further elevation of the superior aspect of the head. This in turn results in hyper-extension in the cervical spine. Such posture is not nearly as comfortable as the neutral anatomical position for the head in the saggital plane.

SUMMARY OF THE INVENTION

According to an aspect of the invention, a posturepedic buoyancy device is provided for supporting a person lying on the device in water in a manner to minimize postural strain. The buoyancy device comprises an inflatable mattress having top and bottom surfaces and in its length direction, head and foot regions. The head region has an elongate recess of a depth approximating that of the mattress to receive and support a person's head when lying on the top surface of the mattress in a prone position. The recess is defined by opposing spaced-apart inflated mattress sections extending generally parallel to one another in the length direction. The mattress sections are spaced apart a distance which supports a person's head when a person is lying in a prone position by contacting a person's cheekbones and accommodates a person's mouth and nose to permit free breathing while lying in a prone position. An inflatable head support cushion is attached to the bottom surface of the mattress and extends transversely of the mattress length direction and beneath the recess to provide additional buoyancy in the head region of the mattress. An inflatable lumbar elevation cushion is attached to the top surface of the mattress intermediate the head and foot regions. The lumbar elevation cushion elevates a person's lumbo-sacral region sufficiently to minimize hyper-extension in a person's lumbo-sacral region while a person is lying prone on the mattress. The elongate recess accommodates variations in a person's trunk length.

According to another aspect of the invention, in a posturepedic buoyancy device having an inflatable air mattress with head and foot regions, the head region comprises an elongate recess extending in a length direction for the mattress. The recess has a depth approximating that of the mattress to receive and support a person's head when lying on the mattress in a prone position, the recess being defined by opposing spaced-apart inflated mattress sections extending generally parallel to one another in the length direction of the mattress, the mattress sections being spaced-apart a distance which supports a person's head when a person is lying in a prone position by contacting a person's cheekbones. This accommodates a person's mouth and nose to permit free breathing while lying in a prone position and also allows the user's head to rest in the neutral anatomical position in the saggital plane and avoids any unnecessary flexion extension or rotation bilaterally of the head.

According to another aspect of the invention in a posturepedic buoyancy device having an inflatable air mattress with head and foot regions, an inflatable lumbar elevation cushion is attached to a top surface of the mattress intermediate the head and foot region. The lumbar elevation cushion elevates a person's lumbo-sacral region sufficiently to minimize hyper-extension in a person's lumbo-sacral region while a person is lying prone on the mattress.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
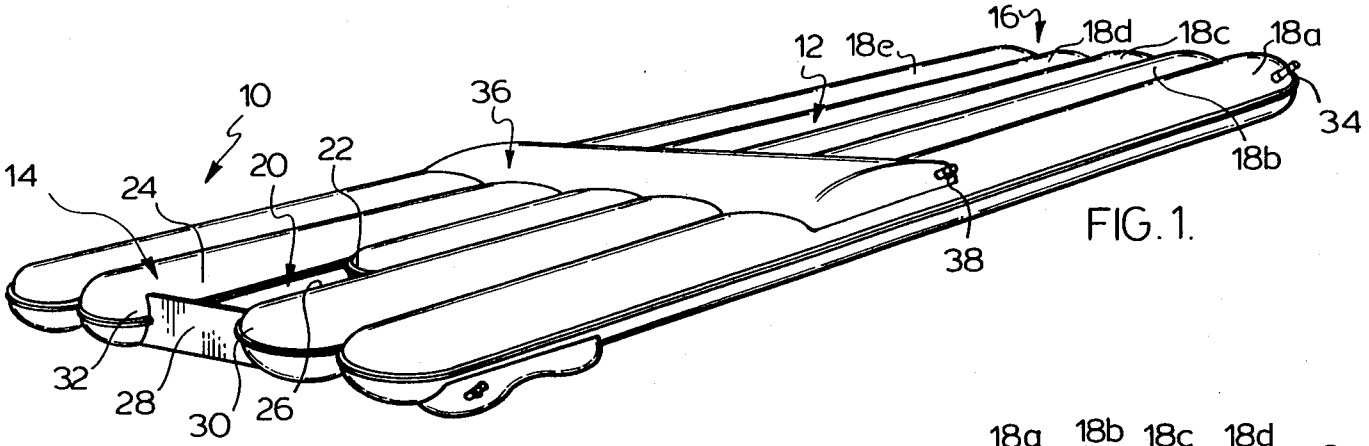
FIG. 1 is a perspective view of the posturepedic buoyancy device according to this invention.

The posturepedic buoyancy device 10, as shown in FIG. 1, has an inflatable air mattress generally designated as 12 with a head region 14 and a foot region 16. According to this embodiment, the mattress 12 is made up of interconnected plurality of tubes 18*a*, 18*b*, 18*c*, 18*d* and 18*e*. Each inflated tube 18 extends in the length direction. The tubes 18*a* through 18*e* are co-terminus at the foot region 16. The central tube 18*c* is shorter than the adjacent tubes 18*b* and 18*d*, hence at the head region 14, a recess 20 is provided. The recess is defined by the end 22 of tube 18*c*, the inflated portions 24 and 26 of mattress tubes 18*b* and 18*d* and a web 28 spanning the outer ends 30 and 32 of tubes 18*b* and 18*d*. The tubes 18*a, b, d* and *e* are all co-terminus at the head region 14 of the mattress.

The air mattress 12 may be constructed in accordance with standard manufacturing techniques. The material of the mattress may be any of a variety of acceptable materials, such as vinyl, vinyl and nylon, vinyl and rayon, rubberized cotton, and vinyl canvas. The tubes are interconnected along their adjacent edge portions to other tubes where air flow channels are provided between these connections so that all tubes may be inflated through a single valve or plug device 34.

Intermediate the head and foot regions of the air mattress 12 is a lumbar elevating cushion 36 which is connected to the top surface of the mattress 12. The lumbar elevating cushion 36 is inflatable by valve 38. The cushion may be inflated independently of the tubes of the mattress 12, although it is appreciated that when desired, communication may be provided between one or more of the tubes of the mattress and the cushion 36 to inflate the cushion at the same time as the tubes are being inflated. The lumbar cushion 36 extends transversely of the length direction of the mattress and is preferably of a length approximately equal to the width of the mattress.

Figure 2:
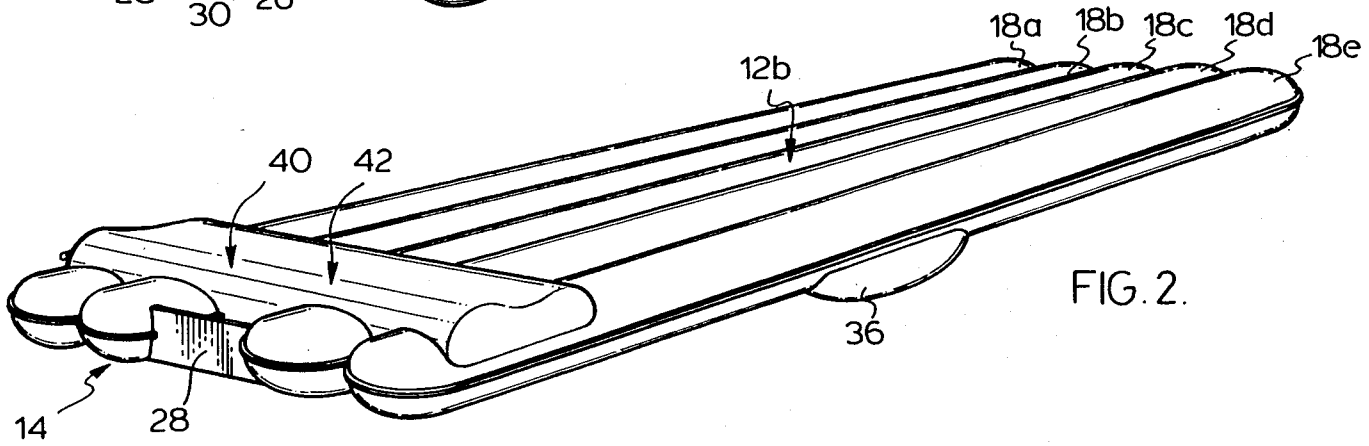
FIG. 2 is a perspective view of the posturepedic buoyancy device of FIG. 1 only turned upside down.

As shown more clearly in FIG. 2, the underside 12*b* of the mattress has at its head portion 14 a head support cushion 40. The head support cushion 40 is connected to the bottom 12*b* of the mattress and extends transversely of the length direction and is of a length approximately equal to the overall width of the mattress. The head cushion 40 has a recessed area generally designated 42 which extends the width of the cushion and which can support the head from a buoyancy standpoint if needed when the buoyancy device is in the position of FIG. 1. When in the position of FIG. 2, a person lying in a supine position may rest their occiput portion of their head on the recessed area 42 of the cushion 40 in the manner to be discussed with respect to FIG. 3.

Figure 3:
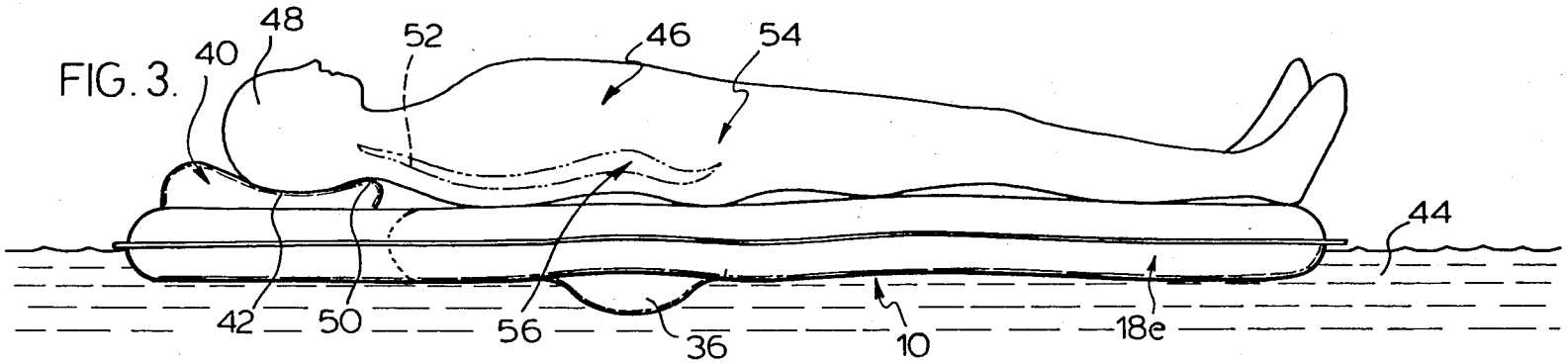
FIG. 3 is a side elevation of the posturepedic buoyancy device of FIG. 2 with an individual lying on the device in the supine position.

For purposes of demonstrating the posturepedic aspects of the buoyance device, the mattress 10 has been shown in FIG. 3 as floating on water 44 with a person 46 lying in the supine position. The person's head 48 is resting on the cushion 40 in the recessed area 42, such that the lower portion 50 supports the natural cervical lordosis of the cervical spine to provide the proper curvature in the spine 52. With the air mattress in the position as shown in FIG. 3, the cushion 36 adds extra buoyancy for the heavier pelvic region 54 of the person so that the person is not bent unduly at the waist while lying in the supine position on the buoyancy device, thereby avoiding any strain on the posterior holding tissues of the lumbar spine.

With the mattress in the water in the position shown in FIG. 1, the person 46 may lie in the prone position in a manner which minimizes stresses on the spinal column to attain as close as possible an ideal postural form. The person's face 58 is positioned in the recess 20 to be supported in a manner which will be discussed with respect to FIG. 5. The lumbar region 56 of the person's body is elevated by the cushion 36. Such elevation of the lumbar region avoids any hyper-extension of the spinal column which may cause lumbar facet irritation, thus trying to achieve as close as possible a proper postural position. When the individual is lying in the prone position, lower back pain may be reduced or avoided by this elevation of the lumbar region.

Figure 5:
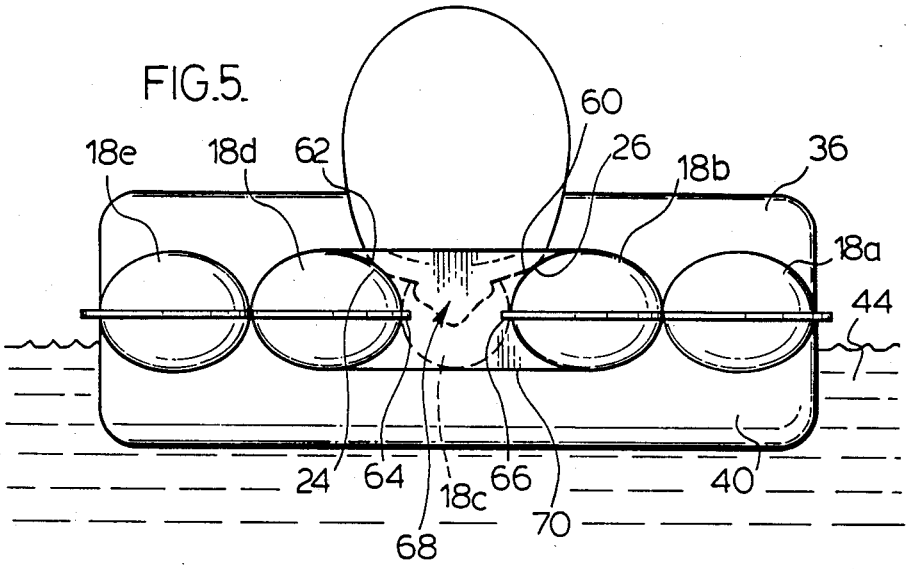
FIG. 5 an end view of the posturepedic buoyancy device of FIG. 4 showing the support of a person's head by mattress sections along each side of the recess.

As shown in FIG. 5, the spacing between the mattress tubes 18*b* and 18*d* is such that the mattress edge portions 24 and 26 contact the person's cheekbones indicated at 60 and 62 and may also contact the person's frontal bone above the orbit of each eye. The spacing between the edges 64 and 66 of tubes 18*b* and 18*d* is such to provide a recess area which accommodates the facial area 68 of the nose and mouth to ensure free breathing while the user is lying in the prone position. With this particular arrangement, the adjacent tubes 18*b* and 18*d* are slightly wider than narrower tube 18*c* so as to define the proper spacing between the support regions 24 and 26 to contact the person's cheekbones. Normally this is a spacing of about two to three inches. By shaping the supporting portions 24 and 26 to be slightly rounded, some variation is accommodated in a particular person's facial features, such as ranging from youth to adults. To enhance the support of the person's cheekbones, the portions 24 and 26 of the mattress tubes 18*b* and 18*d* may be reinforced by additional fabric or vinyl to ensure that the region is not depressed to an extent which would interfere with free breathing of the person. Where costs permit the reinforcing material or additional fabric placed along tubes 18*b* and 18*d* may be more compatible with the face such as a comfortable fabric material or a synthetic material which has the ability to breath, such as "Gore-tex" (trade mark). The supporting portions 24 and 26 provide a posture in the cervical spine region which is very comfortable, because the head is in the neutral anatomical position in the saggital plane.

It is appreciated that an important feature of the buoyancy device is the ability to support a person in the prone position for extended periods of time without causing hyper-extension in the lumbar spine and rotational stress of the cervical spine. By way of the recessed area, the person may look downwardly into the buoyancy device without twisting the cervical column as is required with former types of air mattresses. To enhance the use of the air mattress and to minimize fear of suffication or clostrophobia, the material at the bottom of the recess and the cushion 40 may be of clear vinyl to permit viewing through the air mattress into the water. It is appreciated that the web material 70 at the base of the recess 20 may be integral with and a continuation of the web material 28 across the end of the recess 20. The cushion 36 in elevating or at least applying an upward buoyancy force on the lumbar region of the body attempts to achieve as close as possible an ideal posture positioning. When the mattress is flipped over and used in the position of FIG. 3, the cushion 36 provides additional buoyancy to maintain the body generally out of the water.

Figure 4:
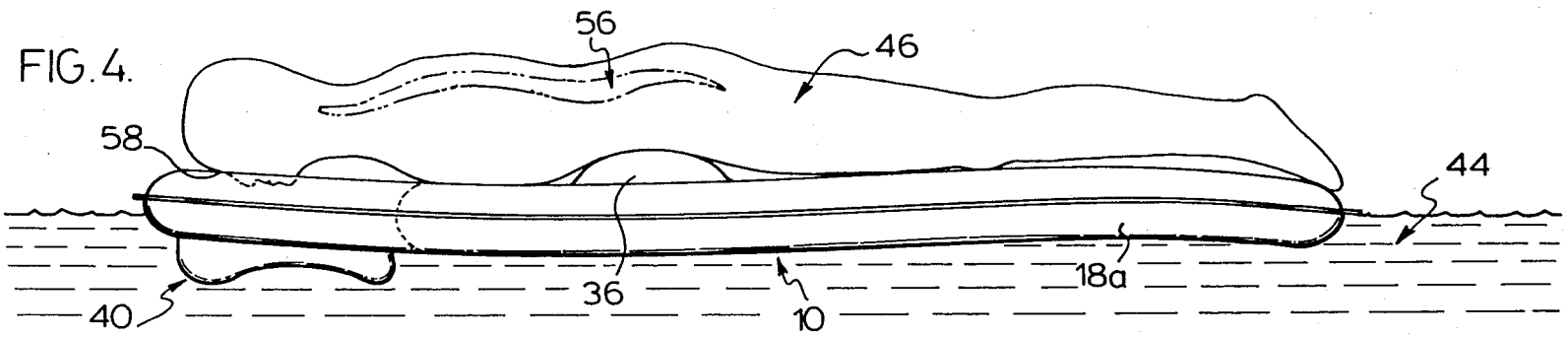
FIG. 4 is a side elevation of the posturepedic buoyancy device of FIG. 1 showing a person lying the prone position.

By providing the elongate recess 20, variations in heights for the body trunk are accommodated since the individual always positions the lumbar region on the cushion 36 and the user's face can then fit anywhere along the elongate recess 20. The cushion 40, when the buoyancy device is used in the position of FIG. 4, provides additional buoyancy in the head region to ensure that the web 28 is above the water line so that the recess 20 does not fill with water when the person is in the prone position. By proper selection of the length of the recess, normal body heights of five feet to six and one half feet can readily be accommodated.

When the buoyancy device is used on dry land, it is appreciated that for the position shown in FIG. 3, the cushion 36 may be deflated by way of operation of the independent valve 38. Similarly, when the buoyancy device is in the position of FIG. 4, the cushion 36 may be inflated. However, the cushion 40 deflates to provide the desired degree of comfort and avoid any hyper-extension of the cervical spine. As shown in FIG. 5, the support portions 24 and 26 of the mattress tubes **18*b* and 18*d*** position the head generally in the plane of the body so as to avoid any extreme flexion, extension or rotation of the head and neck region which occurs with conventional air mattresses.

Figure 6:
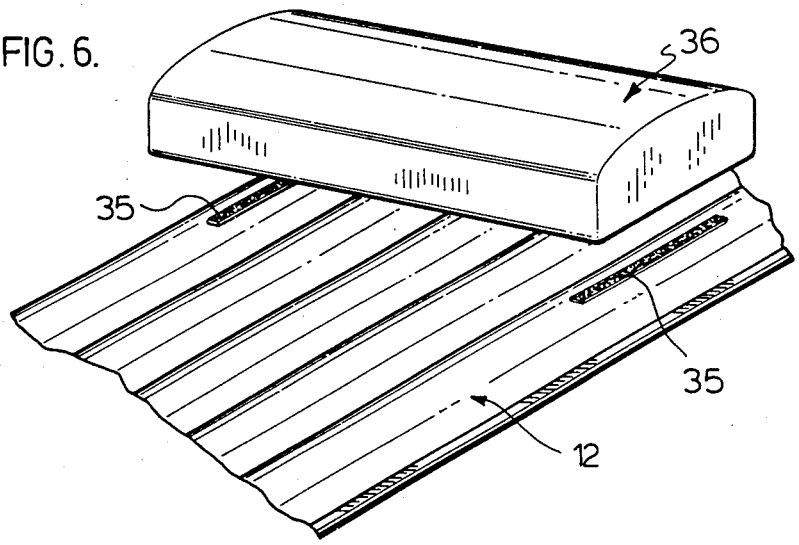
FIG. 6 is a perspective view of a section of the mattress with the lumber support cushion detachably connectable thereto.
Figure 7:
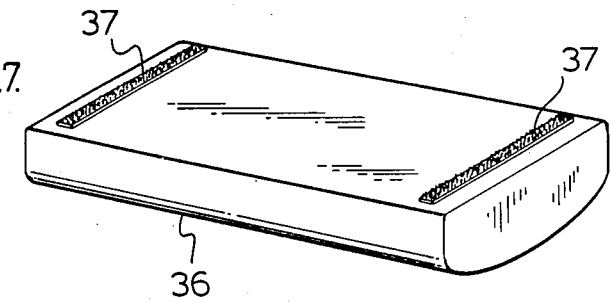
FIG. 7 is an underside view of a lumber support cushion.

It is appreciated that the lumbar support cushion 36 and the head support cushion 40 can be detachably connected to the air mattress by an appropriate connecting device. For example, as shown in FIGS. 6 and 7 the lumbar support cushion 36 may include fasteners 37 which cooperate with mating fasteners 35 on the air mattress to secure the lumbar support cushion to the mattress when desired. Appropriate fasteners include "Velcro" (trademark) type of fastening tape. Similarly, the head cushion 40 may be detachably connected to the air mattress with appropriate fastening device.

The recess area and the lumbar elevating cushion either separately or in combination with the air mattress provides a significantly improved form of buoyancy device in attempting to achieve as closely as possible ideal postural form without involving undue complexity in the shape or manufacture of the article.

Although preferred embodiments of the invention have been described herein in detail, it will be understood by those skilled in the art that variations may be made thereto without departing the spirit of the invention or the scope of the appended claims.

The embodiments of the invention in which an exclusive property or privilege is claimed are defined as follows:

1. A posturepedic buoyancy device for supporting a person lying on said device in water or on land in a manner to minimize postural strain, said buoyancy device comprising an inflatable mattress having top and bottom surfaces and in its length direction head and foot regions, said head region having an elongate recess of a depth approximating that of said mattress to receive and support a person's head when lying on said top surface of said mattress in a prone positon, said recess being defined by opposing spaced-apart inflated mattress sections extending generally parallel to one another in said length dirction, said mattress sections being spaced apart a distance which supports a person's head when a person is lying in a prone position by contacting a person's cheekbones and accommodates a person's mouth and nose to permit free breathing while lying in a prone position, means for bridging said mattress sections across their lower portions to define a bottom of said recess and means for closing said recess along said mattress outer edge, an inflatable lumbar elevation cushion attached to said top surface of said mattress intermediate said head and foot regions, said lumbar elevation cushion elevating a person's lumbo-sacral region sufficiently to minimize hyper-extension in a person's lumbo-scaral region while a person is lying prone on said mattress, said elongated recess accommodating variations in people's trunk length.

2. A posturepedic buoyancy device of claim 1, wherein said lumbar cushion is detachably connected to said mattress by a connecting means, said connecting means providing for repositioning of said lumbar cushion along said length direction of said mattress.

3. A posturepedic buoyancy device of claim 1, wherein said opposing inflated mattress sections are spaced apart approximately two to three inches.

4. A posturepedic buoyancy device of claim 3, wherein said opposing inflated mattress sections are reinforced.

5. A posturepedic buoyancy device of claim 1, wherein said lumbar cushion has means for inflating it independently of means for inflating said mattress.

6. A posturepedic buoyancy device of claim 1, wherein said air mattress comprises a plurality of interconnected parallel inflatable tubes extending in said length direction, one of said tubes being positioned centrally of said plurality of tubes, said plurality of tubes being co-terminus at said foot region of said air mattress, said centrally positioned tube being shorter than remaining said plurality of tubes to define said recess, the tubes on each side of said centrally positioned tube providing said mattress sections along said recess.

7. In a posturepedic buoyancy device of claim 6, said centrally positioned tube being narrower than the other tubes to provide said distance between said mattress sections which support a person's cheekbones.

8. In a posturepedic buoyancy device of claim 1, further comprising an inflatable head support cushion attached to said mattress underside surface and extending transversely of said length direction for the mattress and beneath said recess to provide additional buoyancy in said head region of said mattress.

9. A posturepedic buoyancy device for supporting a person lying on said device in water or on land in a manner to minimize postural strain, said buoyancy device comprising an inflatable mattress having top and bottom surfaces and in its length direction head and foot regions, said head region having an elongate recess of a depth approximating that of said mattress to receive and support a person's head when lying on said top surface of said mattress in a prone position, said recess being defined by opposing spaced-apart inflated mattress sections extending generally parallel to one another in said length direction, said mattress sections being spaced apart a distance which supports a person's head when a person is lying in a prone position by contacting a person's cheekbones and accommodates a person's mouth and nose to permit free breathing while lying in a prone position, an inflatable head support cushion being provided on said bottom surface of said mattress and extending transversely of said mattress length direction and beneath said recess to provide additional buoyancy in said head region of said mattress, wherein said head support cushion has means for inflating it independently of means for inflating said mattress, an inflatable lumbar elevation cushion attached to said top surface of said mattress intermediate said head and foot regions, wherein said lumbar cushion has means for inflating it independently of means for inflating said mattress, said lumbar elevation cushion elevating a person's lumbo-sacral region sufficiently to minimize hyper-extension in a person's lumbo-sacral region while a person is lying prone on said mattress, said elongate recess accommodating variations in people's trunk length, said air mattress comprising a plurality of interconnected parallel inflatable tubes extending in said length direction, one of said tubes being positioned centrally of said plurality of tubes, said plurality of tubes being co-terminus at said foot region of said air mattress, said centrally positioned tube being shorter than remaining said plurality of tubes to define said recess, the tubes on each side of said centrally positioned tube providing said mattress sections along said recess, said lumbar elevation cushion being transversely arranged and of a length substantially equal to the width of said mattress.

10. A posturepedic buoyancy device of claim 9, wherein said head support cushion is detachably connected to said mattress by a connecting means.

11. A posturepedic buoyancy device of claim 9, wherein said head support cushion has means for inflating it independently of means for inflating said mattress.

* * * * *